United States Patent [19]

Tower et al.

[11] Patent Number: 4,789,313

[45] Date of Patent: Dec. 6, 1988

[54] APPARATUS FOR AND METHOD OF PUMPING OUTPUT FLUIDS SUCH AS ABRASIVE LIQUIDS

[75] Inventors: Timothy M. Tower, Seattle; James M. Reichman, Issaquah; Paul D. Harold, Kent, all of Wash.

[73] Assignee: FlowDrill Corporation, Kent, Wash.

[21] Appl. No.: 36,099

[22] Filed: Apr. 8, 1987

[51] Int. Cl.[4] ..... F04B 9/10; F04B 15/02; F04B 23/06

[52] U.S. Cl. ..... 417/388; 417/385; 60/572

[58] Field of Search ..... 417/383–388; 60/572, 573

[56] References Cited

U.S. PATENT DOCUMENTS

| | | | |
|---|---|---|---|
| 2,497,300 | 2/1950 | Elliott | 417/388 |
| 4,304,531 | 12/1981 | Fisher | 417/388 |
| 4,479,758 | 10/1984 | Hersom et al. | 417/388 |

FOREIGN PATENT DOCUMENTS

| | | | |
|---|---|---|---|
| 56-092377 | 7/1981 | Japan | 417/383 |
| 57-008372 | 1/1982 | Japan | 417/385 |
| 0589460 | 1/1978 | U.S.S.R. | 417/383 |

*Primary Examiner*—Carlton R. Croyle

*Assistant Examiner*—Eugene L. Szczecina

*Attorney, Agent, or Firm*—Flehr, Hohbach, Test, Albritton & Herbert

[57] ABSTRACT

A technique for pumping an output fluid, especially a particle-laden abrasive liquid. This technique utilizes an output pump and a drive pump which are interconnected through a common chamber containing a drive fluid, specifically water. The output pump includes an output piston within its own pumping chamber for pumping the output liquid by causing the output piston to move through a complete forward stroke. The drive pump includes a drive piston within its own chamber and means for causing the output piston to move the drive piston through its own complete forward stroke. This pressurizes the drive fluid within the common chamber in a way which causes the output piston to move in the forward direction of its stroke. The two pumps are configured such that the forward stroke of the drive piston defines a greater swept volume than the forward stroke of the output piston, thereby to ensure that the output piston will always move through its entire forward stroke before the drive piston. At the same time, means are provided for continuously replenishing the drive fluid with discrete amounts of cooler drive fluid in order to ensure that the temperature of the overall drive fluid remains at an acceptable low level.

20 Claims, 3 Drawing Sheets

APPARATUS FOR AND METHOD OF PUMPING OUTPUT FLUIDS SUCH AS ABRASIVE LIQUIDS

Figure 1:
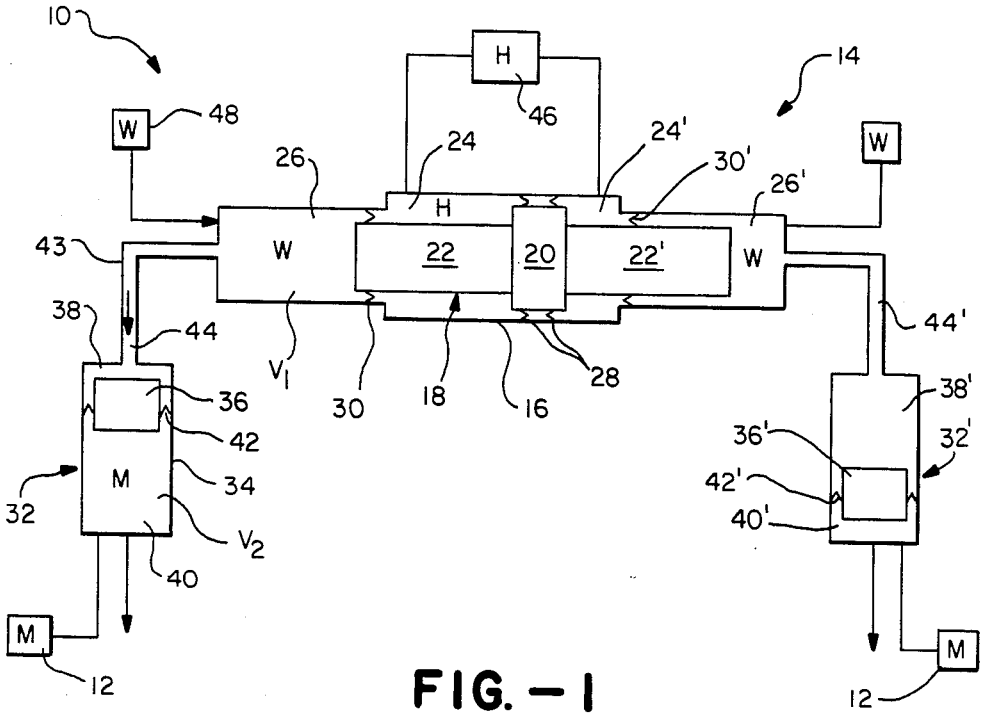

The present invention relates generally to fluid pumping techniques and more particularly to a specifically designed technique for pumping particle-laden abrasive liquids.

In the course of drilling for oil and gas, it is often necessary to pump a variety of fluids into the well which has been designed for that purpose. Many of the fluids utilized contain solid particles which are present to either weight the fluid or as a by-product of the drilling process. One typical way in which these abrasive fluids are pumped is by means of a direct pumping technique. This typical technique utilizes a single piston/cylinder arrangement in which a drive fluid, for example oil, is located on one side of the piston while the abrasive fluid being pumped is located on the other side of the piston. At present, existing pump arrangements of this type can operate at pressures up to about 20,000 psi with reasonable reliability. However, due to the abrasive nature of the drilling fluid the present sealing techniques available for separating the abrasive liquid from the drive fluid cannot reliably withstand the abrasive nature of the drilling fluid at these pressures and operate continuously at a much lower pressure.

As will be seen hereinafter, the present invention provides for a novel alternative to the typical pumping technique in the prior art and specifically an alternative which allows abrasive drilling fluids to be pumped at pressures as high as 45,000 psi in a reliable manner.

In view of the foregoing, it is an object of the present invention to provide a reliable technique for pumping output fluids including abrasive liquids at relatively high pressures including pressures exceeding 5,000 psi. This technique utilizes an output pump and a separate drive pump which are interconnected through a common chamber containing a drive fluid. The drive pump includes a drive piston which is caused to move through a complete forward stroke in order to pressurize the drive fluid which, in turn, causes an output piston forming part of the output pump to move through a complete forward stroke in order to pump the output fluid.

A more specific object of the present invention is to maintain at most a negligible pressure difference across the last-mentioned output piston even though the pressure difference across the last-mentioned drive piston could be quite high. That way, the abrasive nature of the output liquid being pumped will not damage the sealing means associated with the output piston. At the same time, by making the drive fluid nonabrasive, for example water, the pressure across the drive piston can be relatively high without fear of damaging its sealing means.

Another specific object of the present invention is to ensure that the output piston moves through its entire forward stroke (i.e., bottom-out) as it pumps output fluid, even though there is substantially no pressure across the output piston. Otherwise if the output piston does not bottom-out at the end of its forward stroke and conversely top out on the rearward stroke, the effect will accumulate through successive strokes until all pumping stops. The present invention ensures that the output piston bottoms-out at the end of each forward and rearward stroke by designing the drive and output pumps so that the swept volume defined by the drive piston as it moves through each stroke is greater than the swept volume defined by the output piston as it moves through its corresponding stroke. By "swept volume" is meant the volume through which the face of each piston moves in order to complete a stroke. In the embodiment illustrated, the drive and output pistons are designed so that the former moves through longer forward and rearward strokes than the latter as they define their respective swept volumes.

Still another specific object of the present invention is to maintain the drive fluid between the drive and output pistons at an acceptably low temperature. This is accomplished by replacing a discrete amount of the drive fluid with new, cooler drive fluid after each forward pumping stroke of the drive and output pistons. This is particularly possible in an uncomplicated way because the drive piston is caused to move through a greater swept volume during its forward stroke (and also rearward stroke) than the output piston causing the output piston to bottom-out first. At the end of the forward stroke of the output piston, the drive piston still has an incremental distance to move before it bottoms-out. The volume of drive fluid associated with this extra movement is removed from the common chamber between the two pistons, preferably by means of a pressure responsive check valve located directly on the output piston, as will be seen. In a similar manner, as the output piston bottoms-out at the end of its rearward stroke, the drive piston has further to move before it bottoms-out at the end of its rearward stroke. This additional movement creates a negative pressure within the common chamber. In a preferred embodiment of the present invention, a pressure valve responsive to this negative pressure is utilized to introduce a new batch of cooler drive fluid into the common chamber.

Yet another specific object of the present invention is to provide a method of injecting additives or the like into the output fluid being pumped in an uncomplicated and reliable manner. This is accomplished by using the type of arrangement described briefly above in which discrete batches of drive fluid are removed through a check valve in the output piston so as to mix with the output fluid being pumped. Thus, by adding the desired additive to the drive fluid, it is discretely injected into the output fluid.

The present invention will be described in more detail hereinafter in conjunction with the drawings wherein:

FIG. 1 diagrammatically illustrates an apparatus for pumping an output fluid, particularly a particle-laden abrasive liquid, at relatively high pressures. FIG. 1 specifically illustrates a drive pump including a drive piston and a separate output pump including an output piston which are interconnected through a common chamber containing a drive fluid.

Figure 2:
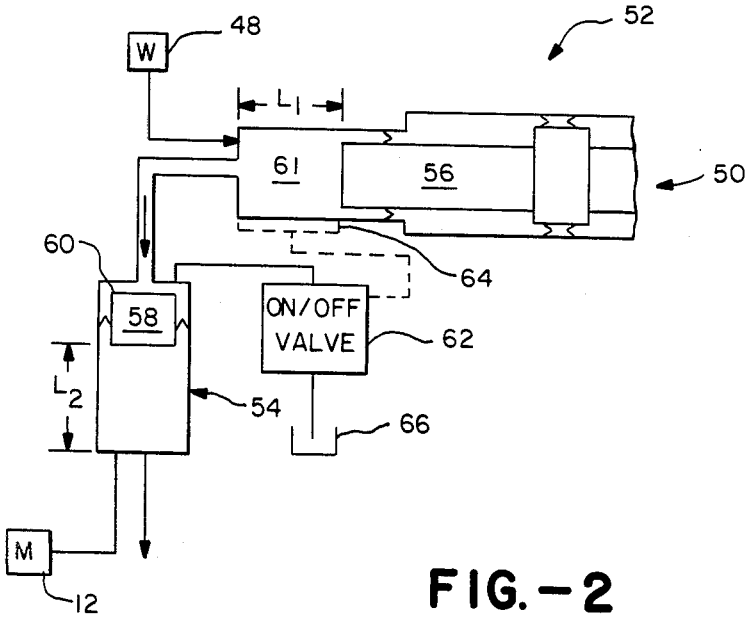

FIG. 2 diagrammatically illustrates a modified version of the pumping apparatus of FIG. 1, specifically a pumping apparatus which is designed in accordance with one embodiment of the present invention to ensure that its output piston bottoms-out at the end of its forward and rearward strokes and to ensure that the drive fluid between its drive and output pumps is maintained at an acceptably low temperature.

Figure 3A:
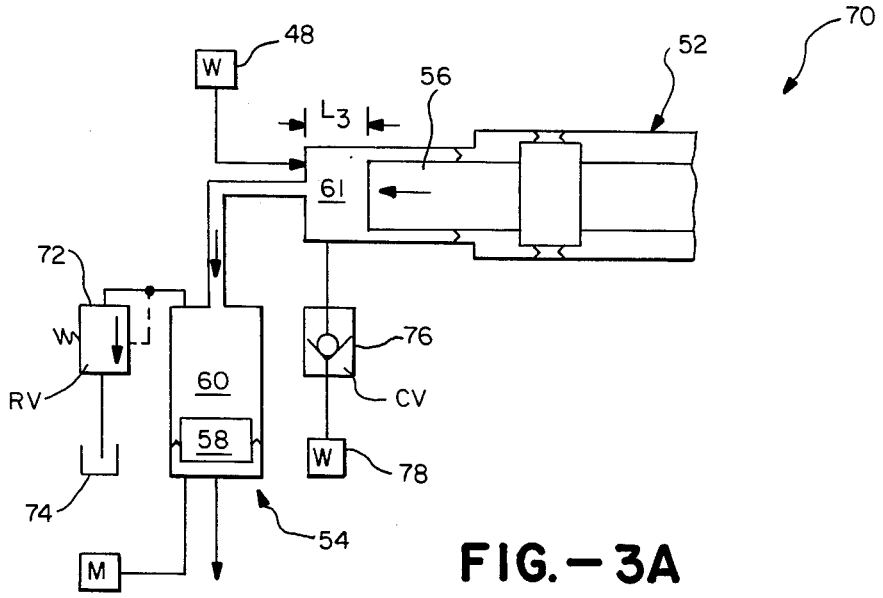
Figure 3B:
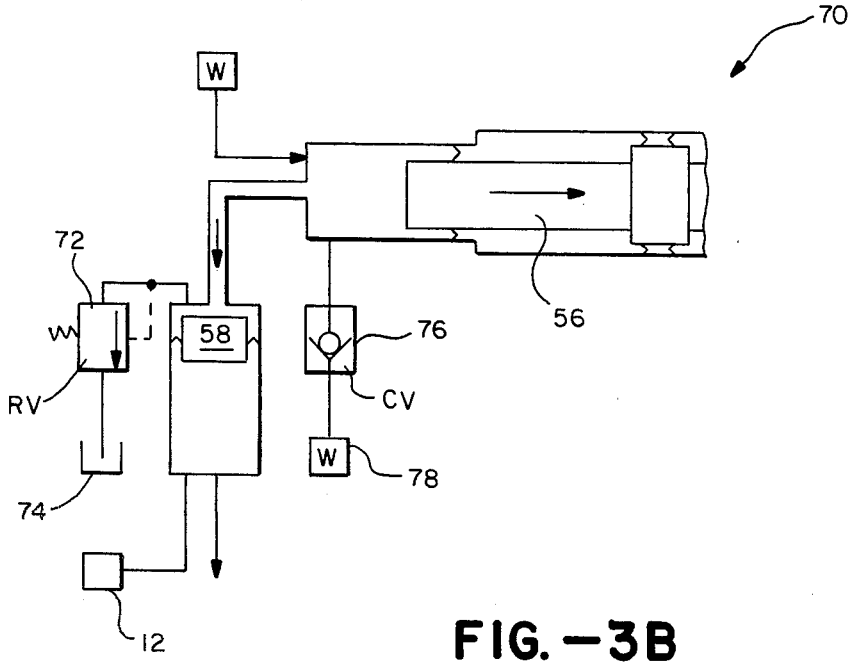

FIGS. 3*a* and 3*b* diagrammatically illustrate different operating positions of a pumping apparatus designed in accordance with the second embodiment of the present invention.

Figure 4:
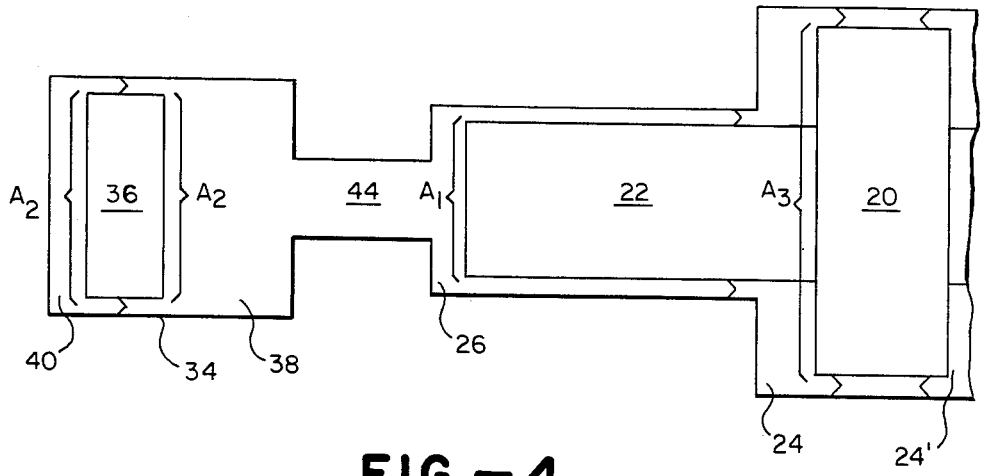

FIG. 4 diagrammatically illustrates how each of the embodiments shown in FIGS. 2 and 3 ensures that their respective output pistons bottom-out at the ends of the forward and rearward strokes.

Figure 5:
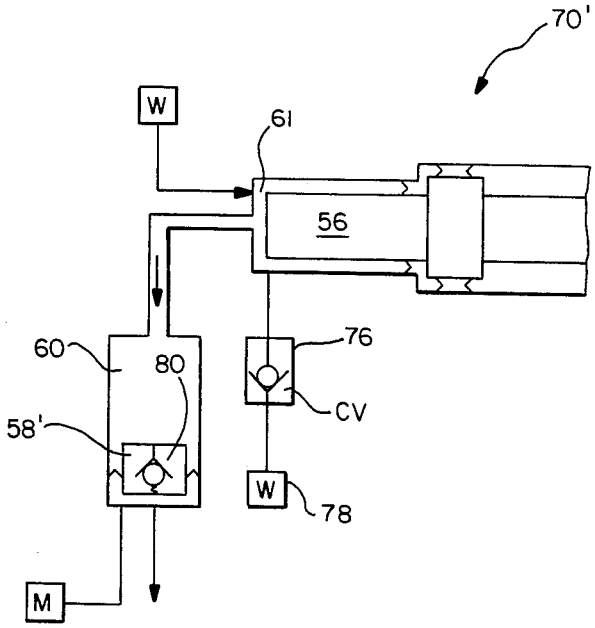

FIG. 5 diagrammatically illustrates a pumping apparatus designed in accordance with a third embodiment of the present invention.

Turning now to the drawings, wherein like components are designated by like reference numerals throughout the various figures, attention is first directed to FIG. 1. This figures diagrammatically illustrates the relatively high pressure apparatus 10 for pumping output fluid, especially a particle-laden abrasive liquid material which will be referred to hereinafter merely as "mud". The mud which is referred to by the letter M in the drawings is supplied to the pumping apparatus from a suitable source generally indicated at 12. Pumping apparatus 10 includes a drive pump 14 in the form of a conventional, readily available intensifier, as illustrated in FIG. 1.

Intensifier 14 includes a housing 16 defining a longitudinally extending compartment which contains a drive piston 18 mounted within the compartment for slidable movement along the axis of the latter. The output piston is comprised of two cylindrical sections, a relatively large rearward section 20 and an axially extending, forward section 22 which is smaller in diameter. The actual intensifier illustrated in FIG. 1 is a double actuating intensifier and therefore drive piston 18 includes a second smaller section 22' coaxial with section 22 on the opposite side of larger section 20. The overall drive piston is located coaxially within the compartment defined by housing 16 so as to divide the compartment into drive chambers 24 and 24' and compression or output chambers 26 and 26'. Note that the drive chambers 24 and 24' are located on opposite sides of piston section 20 and separated from one another by suitable seals 28 which are carried by section 20 and which are disposed in slidable engagement with the inner wall of housing 16. The compression or output chambers 26 and 26' are separated from the drive chambers by suitable fixed seals 30 and 30' located around the inside surface of housing 16 at the positions shown in FIG. 1.

Still referring to FIG. 1, pumping apparatus 10 is shown including an output pump 32 associated with one end of drive pump 14 and a second identical output pump 32' associated with the other end of the drive pump which, as stated above, is illustrated as a double actuating intensifier in FIG. 1. Output pump 32 includes a housing 34 defining an axially extending compartment which contains an output piston 36 mounted within the compartment for movement along the axis of the latter. The output piston divides the compartment defined by housing 34 into two chambers, a drive chamber 38 and an output or compression chamber 40. A suitable seal 42 mounted around piston 36 and engaging the inner wall defined by housing 34 separates the two chambers 38 and 40 from one another. For reasons to become apparent hereinafter, the drive chamber 38 of output pump 32 is placed in fluid communication with the compression or output chamber 26 of drive pump 14 by suitable housing means such as a conduit 43 for defining a continuous passageway 44 therebetween. Functionally speaking, as will also be seen, compression or output chamber 26, passageway 44 and drive chamber 38 together form a common chamber between the drive and output pumps.

As indicated above, output pump 32' is identical to output pump 32. Therefore, output pump 32' includes the same components which are designated by the same reference numerals but primed (′), as shown in FIG. 1. As also seen in FIG. 1, the drive chamber 38' of output pump 32' is placed in fluid communication with compression or output chamber 26' by means of a suitably defined passageway 44'.

Having described many of the components making up overall pumping apparatus 10, attention is now directed to the way in which the apparatus functions to pump discrete batches of mud M or any other such output fluid. At the outset it will be assumed that drive piston 18 and output pistons 36 and 36' are initially in the positions illustrated in FIG. 1. With this positional relationship in mind, drive chamber 24' is initially pressurized hydraulically with drive fluid H, for example oil, from a suitable source 46. This causes the drive piston to move to the left forcing drive fluid H in drive chamber 24 back to source 46, making the hydraulic drive arrangement a closed system which is typical. Before drive piston 18 begins to move to the left, the compression or output chamber 26 is filled with what may be referred to as an intermediate drive fluid, preferably water, generally indicated by the letter W, typically by bleeding the drive fluid through a temporarily opened port (not shown) in a known manner. This discrete batch of intermediate drive fluid is applied from a suitable source indicated generally at 48. It is important to note that the intermediate drive fluid fills not only chamber 26 but also the drive chamber 38 of output pump 32 and intermediate passageway 43. In other words, the overall common chamber between the drive pump and the output pump is filled with the intermediate drive fluid. As drive piston 18 moves to the left it pressurizes the intermediate drive fluid W thereby causing the latter to begin moving output piston 36 in a downward direction as viewed in FIG. 1. However, prior to this occurring, the output or compression chamber 40 of output pump 32 is filled with a discrete batch of mud M or other such output fluid from source 12 through a suitable valve means such as a check valve (not shown). Thus, as the output piston moves downward, it pumps the batch of mud out of pump 32 through similar valve means (not shown).

The foregoing has been a description of one-half of a complete cycle for pumping a discrete batch of mud from one output end of overall pump 10. That half of the cycle is completed when the drive piston 18 and output piston 36 complete their strokes to the left and downward, respectively. For purposes of discussion, these strokes forming the first half of the overall cycle will be referred to as forward strokes. The second half of the cycle is carried out by moving the drive and output pistons through complete rearward strokes, that is, to the right and upward, respectively. The drive piston 18 is moved back to its initial position illustrated in FIG. 1 by hydraulically pressurizing drive chamber 24 with drive fluid H while allowing the drive fluid in chamber 24' to return to source 46. At the same time, output or compression chamber 40 of output pump 32 is pressurized with a new batch of mud M so as to cause the output piston 36 to move back to its initial position shown in FIG. 1. Obviously, to accomplish this, chamber 40 must be pressurized to a level sufficiently high to overcome the pressure within the common chamber comprised of chambers 26 and 38 and passageway 43. In this regard, it should be noted that if the pistons 18 and 36 move through strokes defining equal swept volumes, the intermediate drive fluid W would not have to be replaced, theoretically, and source 48 would only be required initially to fill the common chamber. However, with a relatively high pressure system, e.g., on the order of 5,000 psi, the intermediate drive fluid in such a closed system tends to get very hot and might possibly damage seals 30 or 42. As will be seen hereinafter, the present invention solves this problem.

The foregoing has been a description of one complete cycle of output pump 10 for pumping a discrete batch of mud M at the output of pump 32. It should be apparent from FIG. 1 and the foregoing description that drive pump 14 cooperates with output pump 32' in the same way to pump the same batches of mud at the output of pump 32'. However, the output pump 32' operates 180° out of phase with output pump 32 with respect to drive pump 14. That is, the movement of drive piston 14 from the right to the left is the forward stroke for output pump 32 and the rearward stroke for output pump 32' and the reverse of this is true when the drive piston moves from left to right. It is to be understood that the present invention does not require a double actuating intensifier and could readily operate with a single output pump 32. Under these circumstances, the overall apparatus would not include a piston section 22', a compression or output chamber 26' or an output pump 32'. The only primed component that would still be required would be the drive chamber 24' on the opposite side of piston section 20 from drive chamber 24. Also, while various components making up overall apparatus 10 have been shown interconnected by means of flow arrows and while the outputs and inputs to the apparatus have been shown by means of arrows, suitable and readily providable conduits and other cooperating means to operate the overall apparatus in the manner described are contemplated.

Still referring to FIG. 1, in conjunction with FIG. 4, a number of features of apparatus 10 should be noted. First, since drive pump 14 is an intensifier, the intermediate drive fluid within output or compression chamber 26 is pressurized to pressures which are greater than the pressure within drive chamber 24' required to move the drive piston through its forward stroke. This pressure differential across the intensifier is directly proportionate to the ratio of areas A1 and A3 of piston sections 22 and 20, respectively, as is well-known in the art. In an actual working embodiment, the drive piston is operated at pressures as high as 5,000 psi and the pressure difference between its drive chamber and compression or output chamber is as high as 45,000 psi. Nevertheless, because both of these chambers contain "clean or clear" fluid, for example oil in the case of drive fluid H and water in the case of intermediate drive fluid W, the two chambers can be reliably sealed from one another by means of a readily available dynamic seal 30. At the same time, as best illustrated in FIG. 4, opposite sides of output piston 36 are defined by equal surface areas A2. Therefore, there is no intensification across that piston which means there is substantially no pressure difference between chamber 38 (actually the entire common chamber made up of chambers 26 and 38 and passageway 44) and chamber 40. Indeed the only pressure across output piston 36 results from friction between its seal 42 and the inner wall of housing 34 as the piston moves. This results in a pressure differential of about 200 psi which for all practical purposes can be ignored. Thus, seal 42 could be a readily providable standard seal, even in the presence of an abrasive output fluid such as mud M.

It was assumed above that drive piston 18 and output piston 36 move define the same swept volume through their respective forward and rearward strokes. In accordance with one aspect of the present invention, this is not the case. Rather, both the drive pump 14 and output pump 32 are designed so that the drive piston defines greater swept volume as it moves through its forward and rearward strokes than does the output piston. This ensures that the output piston bottoms-out at each end of its stroke, as indicated above. At the same time, this differentiation in swept volume between the two pistons provides for an uncomplicated and yet reliable way to intermittently replenish the intermediate drive fluid W in order to kep it at an acceptably low temperature, as will be seen hereinafter.

Still referring to FIG. 4, the "swept volume" of drive piston 22 is that volume through which the piston moves during a complete stroke. That volume is equal to its stroke length times the area A1 of its front face. The "swept volume" of output piston 36 is equal to its stroke length multiplied by the area A2 of its front face. As stated above, so long as the swept volume of piston 22 is greater than the swept volume of piston 36, the latter will complete its stroke (i.e., bottom-out) first. If it is desired to move the drive piston through a greater stroke than the output piston, one way to ensure this is to make A1 greater than A2. By preselecting particular values for A1 and A2 for given swept volumes, the particular stroke length for each of the pistons can be predetermined. These stroke lengths can be made to be equal, or the stroke length of either piston can be made to be longer or shorter than the other. So long as the swept volume defined by drive piston 18 exceeds the swept volume for output piston 36, the latter is assured of bottoming-out at each end of its stroke first regardless of their respective stroke lengths. Moreover, the difference in volume through which the two pistons move determines the actual amount of intermediate drive fluid W which is replaced during each cycle of operation, as will be seen hereinafter. For purposes of convenience, during the following description, it will be assumed that A1 is equal to A2 and that the stroke length of the drive piston in each embodiment to be described is greater than the stroke length of its associated output piston.

Turning now to FIG. 2, attention is directed to a pumping apparatus 50 which may be identical to previously described apparatus 10 with some exceptions to be discussed. Like apparatus 10, apparatus 50 includes a drive pump 52 and an output pump 54 which may be identical to pumps 14 and 32, respectively, except that the pumps making up apparatus 52 are configured so that the piston 56 forming part of pump 52 defines a greater swept volume and, in the particular embodiment illustrated, moves through a longer stroke L1 than piston 58 forming part of pump 54. As illustrated in FIG. 2, piston 58 moves through a stroke having a length L2 which is less than the length L1. The two pumps 52 and 54 are designed in the manner described immediately above to provide these different stroke lengths, although they could be designed with different stroke length ratios so long as the swept volume of piston 56 is greater than the swept volume of piston 58. Otherwise, the two pumps 52, 54 may be identical in structure and operation. However, because the piston 56 moves through a greater swept volume than piston 58, when this latter piston bottoms-out at the end of its forward stroke, the piston 56 will have an additional volume to move through before it reaches the end of its forward stroke. In order for piston 56 to move through this additional volume, a corresponding amount of intermediate drive fluid W must be removed from the common chamber between the two pumps. As illustrated in FIG. 2, this additional, discrete batch of intermediate drive fluid is removed from the common chamber (specifically from drive chamber 60 corresponding to previously described chamber 38) or its connected chamber 61 (corresponding to previously described chamber 26) by means of a readily providable on/off valve 62. This valve is responsive to the position of piston 56 by suitable detection means, for example a magnetic or optical position indicator generally indicated at 64 for automatically opening valve 62 when piston 58 bottoms-out at the end of its forward stroke. Valve 62 remains open until piston 56 bottoms-out, thereby forcing the excess intermediate drive fluid out of chamber 60 and into, for example, a reservoir generally indicated at 66.

The discussion immediately above related to the forward half cycle of apparatus 52. During the rearward half cycle, pistons 56 and 58 are moved through their rearward strokes in the manner described with respect to apparatus 10. Because piston 58 moves through a smaller swept volume than piston 56, it bottoms-out first, as discussed above. At the time piston 58 bottoms-out, the piston 56 is still moving to complete its rearward stroke. At that time, a separate on-off valve corresponding to valve 62 or the valve 62 itself may be opened to direct a new batch of intermediate drive fluid into chamber 60. If a separate valve is used, it could be connected with a totally separate supply of cooler secondary drive fluid. If valve 62 is used, it could obtain secondary drive fluid from reservoir 66 which could be provided with means for cooling down the fluid contained therein. In either case, the valve would include means similar to position detecting means 64 to sense when piston 58 has bottomed-out during its rearward stroke in order to open the valve during the period that piston 56 is still moving.

Having described apparatus 52, attention is now directed to FIGS. 3A and 3B which illustrate another apparatus 70 that may be identical to apparatus 52, except for the way in which secondary drive fluid is removed from and added to chambers 60 and/or 61. Thus, apparatus 70 includes an identical drive pump 52 and output pump 54 which respectively include their own drive pistons 56 and 58. However, as will be seen immediately below, the on-off valve 62 and associated position sensing means are replaced with a readily providable pressure valve 72 and associated reservoir 74 and a readily providable check valve 76 and an associated supply of relatively cool intermediate drive fluid W, indicated generally at 78.

In FIG. 3A, the piston 58 is shown just bottoming-out at the end of its forward stroke while the piston 56 us still moving toward the end of its forward stroke. The piston 56 still has the length L3 and corresponding volume to move through before it bottoms-out. As piston 56 moves through this additional length L3, the pressure within the common chamber between the two pumps (corresponding to the common chamber made of chambers 26, 38 and passageway 44 in FIG. 1) increases in pressure to a predetermined level which causes pressure valve 72 to open. This pressure valve opens up a passageway from chamber 60 (part of the common chamber) to the reservoir 74 so that a discrete batch of secondary fluid is forced into the reservoir as piston 56 bottoms-out. This discrete batch corresponds to the difference in swept volume between the drive and output pistons.

FIG. **3*b* illustrates apparatus 70 at a point in its cycle where piston 58 has just bottomed-out at the end of its rearward stroke. At that time, piston 56 is still moving towards the end of its rearward stroke. As a result of the continued movement of piston 56, a negative pressure is created within the common chamber. This causes the check valve 76 to open, thereby opening a passageway from secondary drive fluid supply 78 to chamber 61 so that by the time piston 56 completes is rearward stroke, the previously removed batch of secondary drive fluid is replaced with a new batch which is cooler than the second drive fluid already in the common chamber (chambers 60 and 61** and the passage therebetween). This, in turn, helps to maintain the secondary drive fluid at a suitably low temperature.

Turning now to FIG. 5, attention is directed to still another fluid pumping apparatus 70' which may be identical to apparatus 70 illustrated in FIGS. 3A and 3B, with one exception. The apparatus 70 was described including the pressure valve 72 for removing discrete batches of drive fluid during each forward stroke of its pistons 56 and 58. In apparatus 70' which is the preferred apparatus disclosed herein, the pressure valve 72 and its associated reservoir 74 are eliminated. At the same time, the output piston 58 is replaced with a modified output piston 58' illustrated in FIG. 5. This latter output piston carries with it a readily providable spring-loaded check valve 80 located within a passage across the drive piston. This check valve functions in the following manner. As the output piston is caused to move through its forward stroke, the spring-loaded check valve remains closed (due to its spring-loading). When the output piston bottoms-out, the pressure behind it increases due to the continued movement of the drive piston. This automatically causes check valve 80 to open, thereby forcing a discrete batch of drive fluid through the output piston and into the fluid being pumped, that is, the mud M. The amount of drive fluid that is ejected through the output piston corresponds to the difference in swept volume between this latter piston and the drive piston 56, as described previously. Because the check valve 80 is a one-way valve, as the output piston moves through its rearward stroke, the check valve remains closed.

The utilization of an internal check valve within the output piston has a number of advantages. First, it eliminates external plumbing associated with the pressure valve 72 forming part of apparatus 70. Moreover, if check valve 80 should for some reason fail, it will not shut down the apparatus as would pressure valve 72 if it failed. All that would happen is that a larger amount of drive fluid would be ejected out through the output valve during each forward stroke. While it is true that check valve 80 may be exposed to a particle-laden output fluid, specifically mud M, whereas this is not the case with respect to pressure valve 72, it should be noted that each time a batch of clear (clean) drive fluid is ejected through check valve 80, it serves to clean the valve's seat of the particulate material that might be there. Still another advantage in using the internal check valve in the apparatus illustrated is that the check valve is located across a relatively low pressure differential, which, as discussed previously, is negligible. This is to be contrasted with pressure valve 72 which is located between the relatively high pressure chamber 60 and the much lower pressure in the ambient surroundings.

A further and very important advantage of providing internal check valve 80 resides in the ability to inject additives into the fluid being pumped, if that is desired, in a relatively uncomplicated and reliable manner. In other words, the check valve 80 can be utilized as a metering valve to meter special polymers or other such additives to, for example, reduce friction or otherwise treat the output fluid being pumped.

What is claimed is:

1. An apparatus for pumping an output fluid, especially a particle-laden liquid material comprising:

(a) an output pump including an output piston and its own pumping chamber for pumping a discrete amount of said output fluid from its pumping chamber by causing said output piston to move through a complete forward stroke;

(b) a drive pump including a drive piston and its own pumping chamber connected with said output pump through a common chamber containing intermediate drive fluid, said drive pump having means for moving said drive piston through its own complete forward stroke in order to pressurize said drive fluid within said common chamber in a way which causes said output piston to move in the forward direction of its stroke; and (c) said drive pump and output pump being configured such that the forward stroke of said drive piston defines a greater swept volume than the forward stroke of said output piston for causing the output piston to move through its entire forward stroke before said drive piston completes its forward stroke, whereby as said drive piston moves through its entire forward stroke, a predetermined amount of said drive fluid must be removed from said common chamber;

(d) means for removing said predetermined amount of drive fluid from said common chamber each time said drive piston moves through its entire forward stroke; and (e) means for adding the same amount of new drive fluid to said common chamber before the next successive forward stroke of said drive piston, whereby the new fluid can be provided at a colder temperature than the drive fluid already in the one common chamber in order to lower the temperature of all of the drive fluid within the common chamber;

(f) said output pump including means for causing said output piston to move through a complete rearward stroke after having moved through a complete forward stroke by refilling the pumping chamber of said output pump with the same discrete amount of new output fluid that was previously pumped out of said last-mentioned chamber, and said drive pump including means for causing said drive piston to move through a complete rearward stroke after having moved through a complete forward stroke, said last-mentioned means being synchronized with said means for causing said output piston to move through its rearward stroke such that the two pistons start their rearward strokes at the same time and such that said output piston completes its rearward stroke before said drive piston completes its rearward stroke, whereby during the time said drive piston is completing its rearward stroke after said output piston has stopped, a negative pressure is created in said common chamber.

2. An apparatus according to claim 1 wherein the pumping chamber of said output pump and said common chamber lie on opposite sides of said output piston and wherein said output pump is configured so that as said output piston moves through its stroke it does so with a negligible pressure difference between these last-mentioned chambers.

3. An apparatus according to claim 1 wherein said means for adding new drive fluid to said common chamber includes valve means which opens in response to said negative pressure within said common pressure.

4. An apparatus according to claim 3 wherein, as said drive piston moves through its forward stroke, the pressure of said drive fluid within said common chamber increases and wherein said means for removing drive fluid from said common chamber includes valve means which opens when the pressure within said common chamber reaches a predetermined level during the forward stroke of said drive piston.

5. An apparatus according to claim 4 wherein said last-mentioned valve means is located in said output piston such that the drive fluid removed from said common chamber is directed into said output fluid, whereby said drive fluid can be provided with an additive to be injected into said output fluid.

6. An apparatus according to claim 5 wherein said last-mentioned valve means is a spring-loaded check valve.

7. An apparatus according to claim 1 wherein said drive fluid is water and said output liquid is said particle-laden liquid material.

8. An apparatus according to claim 1 wherein said drive and output pumps are configured such that the forward stroke of said drive piston is longer than the forward stroke of said output piston.

9. An apparatus according to claim 1 including means for removing said predetermined amount of drive fluid from said common chamber through said output piston and into said output fluid.

10. An apparatus according to claim 9 wherein said removing means comprises a spring-loaded check valve.

11. A method of pumping an output fluid such as particle-laden liquid material, comprising the steps of:

(a) providing an output pump including an output piston and its own pumping chamber containing a discrete amount of said output fluid, and a drive pump including a drive piston and its own pumping chamber;

(b) connecting said output and drive pumps together through a common chamber containing drive fluid; and (c) moving said drive piston through a complete forward stroke within its pumping chamber in order to pressurize said drive fluid within said common chamber in a way which causes said output piston to move in the forward direction of its stroke, said drive piston being caused to move through an entire forward stroke which defines a greater swept volume than the swept volume defined by the complete forward stroke of said output piston in order to cause the output piston to move through its entire stroke before said drive piston completes its forward stroke, whereby the movement of said output piston through its entire stroke causes said discrete amount of output fluid to be pumped from the pumping chamber of said output pump and whereby, as said drive piston moves through its entire forward stroke, a predetermined amount of said drive fluid must be removed from said common chamber (d) removing said predetermined amount of drive fluid from said common chamber each time said drive piston moves through its entire forward stroke and adding the same amount of new drive fluid to said common chamber before the next successive forward stroke of said drive piston, said new fluid being provided at a colder temperature than the drive fluid already in the common chamber in order to lower the temperature of all of the drive fluid within the common chamber;

(e) causing said output piston to move through a complete rearward stroke after having moved through a complete forward stroke by refilling said pumping chamber of said output pump with the same amount of new output liquid; and (f) causing said drive piston to move through a complete rearward stroke after having moved through a complete forward stroke, in synchronism with said output piston as the latter moves through its rearward stroke such that the two pistons start their rearward strokes at the same time and such that said output piston completes its rearward stroke before said drive piston completes its rearward stroke, whereby during the time said drive piston is completing its rearward stroke after said output piston has stopped, a negative pressure is created in said common chamber.

12. The method according to claim 11 wherein the pumping chamber of said output pump and said common chamber lie on opposite sides of said output piston and wherein said output pump is configured so as said output piston moves within its chamber it does so with a negligible pressure difference between these last-mentioned chambers.

13. The method according to claim 11 wherein said step of adding new drive fluid to said common chamber includes opening up a valve means into said common chamber in response to said negative pressure therein.

14. The method according to claim 13 wherein, as said drive piston moves through its forward stroke, the pressure of said drive fluid within said common chamber increases, and to wherein said step of removing drive fluid from said common chamber includes the step of opening a valve means into said common chamber when the pressure therein reaches a predetermined level during the forward stroke of said drive piston.

15. The method according to claim 14 wherein said last-mentioned valve means is located in said output piston and wherein the drive fluid removed from said common chamber is directed into said output fluid.

16. The method according to claim 15 including the step of providing said drive fluid with an additive.

17. The method according to claim 11 wherein said drive and output pumps are configured such that the forward stroke of said drive piston is longer than the forward stroke of said output piston.

18. The method according to claim 11 including the step of removing said predetermined amount of drive fluid from said common chamber through said output piston and into said output fluid.

19. The method according to claim 18 including the step of adding an additive to said drive fluid.

20. The method according to claim 19 wherein said additive is a polymer.

* * * * *